United States Patent [19]

Martindell

[11] Patent Number: 5,012,708

[45] Date of Patent: May 7, 1991

[54] DEPTH LOCATOR APPARATUS FOR INSERT BIT HOLDERS

[76] Inventor: J. Richard Martindell, 9605 Village Green NE., Albuquerque, N. Mex. 87111

[21] Appl. No.: 526,686

[22] Filed: May 21, 1990

Related U.S. Application Data

[63] Continuation of Ser. No. 391,648, Aug. 7, 1989, abandoned, which is a continuation of Ser. No. 257,272, Oct. 13, 1988, abandoned.

[51] Int. Cl.[5] ..... B25B 23/00

[52] U.S. Cl. ..... 81/429; 81/451; 81/438

[58] Field of Search ..... 81/451, 438, 436, 460, 81/52, 429, 54; 408/202, 241 S, 113

[56] References Cited

U.S. PATENT DOCUMENTS 1,126,370 1/1915 Borresen ..... 81/451

3,707,894 1/1973 Stillwagon, Jr. ..... 81/451 X

*Primary Examiner*—D. S. Meislin

[57] ABSTRACT

Depth locator apparatus for insert bit holders provides a means for adjustably setting the depth of a screw head relative to a fastened work-piece surface. The apparatus is comprised of a sleeve, externally threaded, and with an internal bore to affixedly engage the drive end of a bit holder. The apparatus additionally includes two locking rings with internal threads to engage the external thread of the sleeve. The depth of the fastener relative to the work-piece surface is determined by the location of the outermost lock ring, relative to the insert bit, as it locates against the surface, being constrained against axial movement by the rearmost lock ring.

1 Claim, 1 Drawing Sheet

Fig.1
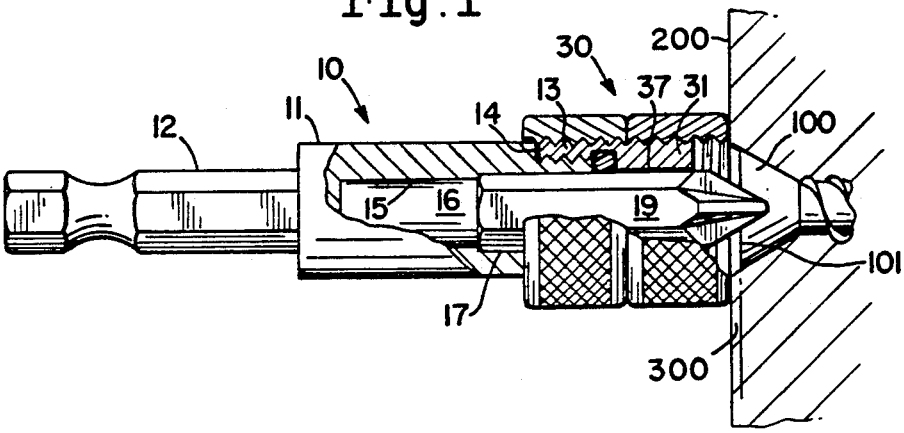
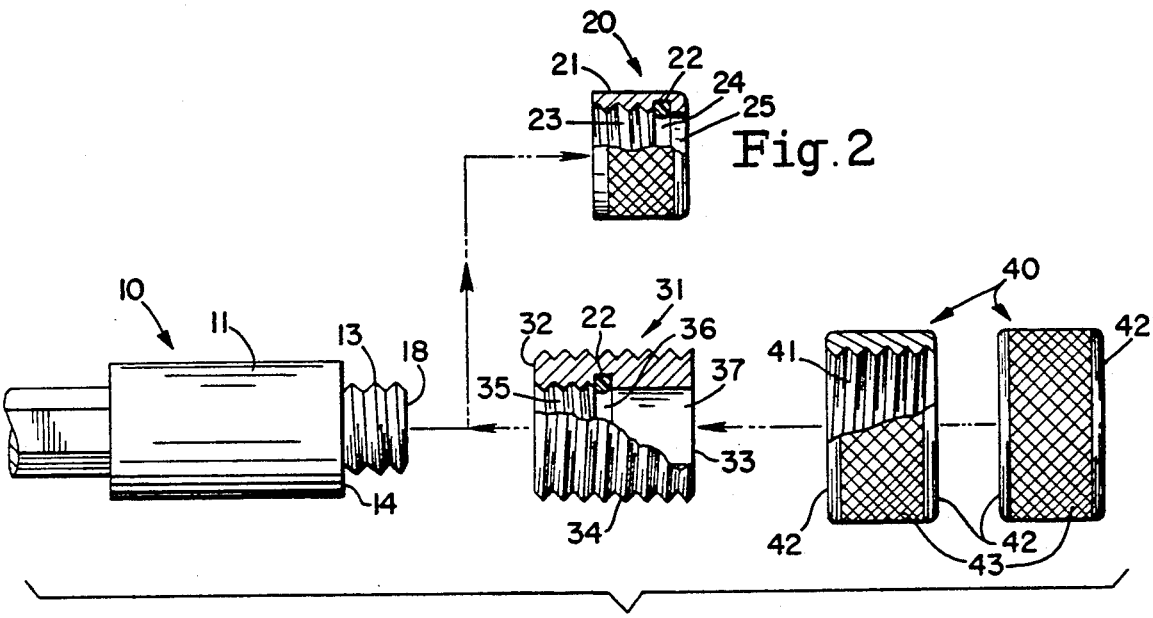
Fig.2
Fig.3
Fig.4
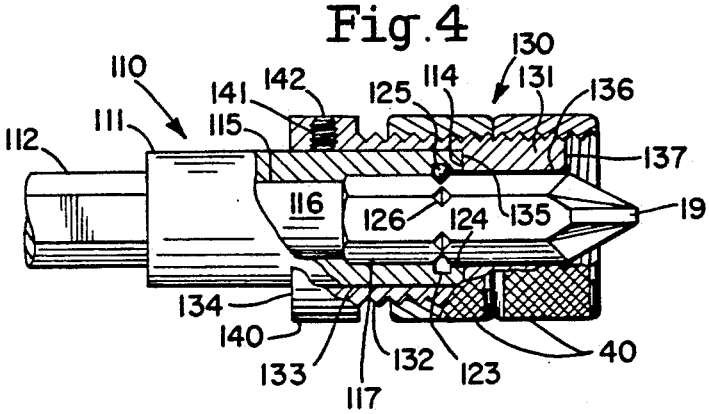

DEPTH LOCATOR APPARATUS FOR INSERT BIT HOLDERS

This application is a continuation of Ser. No. 07/391,648, filed Aug. 7, 1989, which was a continuation of Ser. No. 07/257,272, filed Oct. 13, 1988, both abandoned.

BACKGROUND OF THE INVENTION

1. Field of the Invention

This invention relates to screwdriving bit holder devices for insert bits used to drive screws, having various drive head configurations driven manually or by power, and more particularly, to a method for depth location of the screw.

2. Description of the Prior Art

The prior art delineating holding devices for insert type bits for driving screws is substantial. The concept of, the reason for, and the description of the insert type bit are well documented in Patent to Fischer U.S. Pat. No. 2,522,217. These will not be re-recited here except to note they were based generally on economic considerations. It is noted that Fischer refers to this type of bit as a "unitary bit." The name insert bit appears in Fitch U.S. Pat. No. 2,806,706 and is now used generically for this type of bit. Numerous refinements and new utilities have been advanced for the insert bit and particularly for the bit holding devices for these bits. The most predominant of these has been the addition of permanent magnets of the Alnico type to the bit holding device, which transfers the magnetism to and through the insert bit for retention of the screw to the bit, the merits of which are found in F. G. Clark U.S. Pat. Nos. 2,550,775; 2,671,484; 2,677,294; 2,833,548; 3,007,504; and C. A. Lange U.S. Pat. No. 2,838,082.

The most common bit holders in use at the time of this invention, and described in the following detailed descriptions, are of two types which are commonly known as the C'ring and the nose cap type. These are available in both magnetic and nonmagnetic styles.

The C'ring type in most common use embodies the essential elements of the Fischer U.S. Pat. No. 2,522,217 including: a cylindrical body with a shank for transmitting torque through the body, or alternately an integral socket recess designed to attach in a fixed relationship to a rotating power tool spindle or a manual hand driver; a socket type recess to receive the polygonal shank of the insert bit, now most commonly a hexagon; a shoulder surface at the bottom of this bore to restrain the axial thrust of said bit when in engagement with a screw type fastener; a spring type ring in an internal annular groove in said bore to retain the bit against axial pull out forces either frictionally or more positively by engaging notches being supplied in almost all currently manufactured insert bits. These are prescribed and defined in federal specifications such as GGG-B-00122. The Clark U.S. Pat. No. 2,550,775 embodies these same features, except the retaining ring is replaced by a permanent magnet, located in a bore at the bottom of the bit driving socket, which retains the bit magnetically, but with the added new utility of retaining the fastener magnetically on the end of the bit. Although currently in use, it is limited to applications where the relatively weak holding force of the magnet will not cause problems of a convenience or safety nature should the bit stick in the fastener recess and be pulled out of the bit holder. The bit holder of the C'ring type in most common use at this time is a hybrid of the preceding patents utilizing both the superior holding force of the retaining ring and the utility of the magnet as described above.

The nose cap type bit holder in most common usage at this time, either magnetic or non-magnetic, incorporates the features of the hybrid C'ring bit holder described above. These are: a cylindrical body, shank or socket driving means, socket recess to accept the bit, and a magnet or locating shoulder at the bottom of this recess. An exception is the retaining ring feature which is located in a separate nose cap or sleeve; which has a partially threaded bore to engage like external threads on the end of the cylindrical bit holder body opposite the shank of the driven end. The retaining feature is a rubber O'ring retained in an annular groove at the bottom of the nose cap internal bore. It is compressed in the groove and against the bit, by the end surface of the bit holder, when the cap is threaded onto the bit holder. This compression causes very high frictional forces against the bit, which resist bit pullout should the bit tend to stick in the fastener recess.

Two types of nose cap bit holders are now in common usage. One type has a threaded nose, the major diameter of the threads being the same as or slightly less than the body diameter, the threads of which blend into the body providing no distinct shoulder. The second type, having a larger body diameter, utilizes the same threads, but provides a thread relief and a distinct shoulder, which limits the O'ring compression and subsequent O'ring damage when the nose cap is threaded into place.

The nose cap of these two types of bit holders are interchangeable. This is important to the present invention. In the preferred embodiment, the nose caps are universally adaptable to both types of nose cap bit holders.

The Lange U.S. Pat. No. 2,838,082 shows a sleeve of similar construction and attachment and bit retaining means. The Lange Patent differs from the most commonly used nose cap type bit holders, in that the bit driving socket means is incorporated in the unthreaded portion of the detachable sleeve. The external face of the magnet, located in a bore in the bit holder body, is essentially flush with the threaded end of the bit holder. The bit retaining means in this case being a retainer ring located in an annular groove in the socket portion of the sleeve; located in such relationship with the face of the magnet, as to engage the notches in the insert bit.

The most common nose cap bit holder in use at this time is then seen to be a hybrid of both the C'ring bit holder described above and the nose cap or sleeve type of the referenced Lange Patent. It is also noted that the bit retaining means, used in this now most common hybrid embodiment, is a resilient continuous rubber ring, commonly referred to as an O'ring. This ring develops sufficient frictional holding force to retain the bit, independent of the notches, against normally encountered pull out forces.

An examination of the above cited Patents, as well as currently developed art, indicates one commonality: that being the lack of a feature to locate the depth of the fastener relative to the work surface. It is this new utility for bit holders that the present invention addresses and provides.

Until this new utility, integral with the bit holder, was provided, the method of depth location was incorporated in the driving tools providing rotation of the bit holder shank. These were generally, but not limited to, relatively expensive electric or air driven power tools. This took the form of a depth locator adapter designed specifically for the particular power tool, and available generally only on, power tools designed for screwdriving. These usually incorporated a clutching mechanism associated with the locator adapter. They were generally designed to work only with tools having the hexagonal power shanks, with the detenting annular groove, shown in several of the cited Patents and standardized for industry by ANSI specification B107.4. These are the shanks of the bit holders of the two embodiments described below.

The primary purpose of this shank design was to prevent the slippage that occurs typically in three-jaw key chucks holding round shank tools such as drills; the avoidance of which is of great importance, given the higher torques and impacts associated with screwdriving, and coincidentally, the prevention of axial pull out of the driven tool.

Bit holders of this type incorporating the hexagonal power shanks, as well as many other screwdriving accessories such as nut setters, socket adapters or extensions, power bits and bit finders, were originally designed to be used in power driven screwdrivers with compatible hex chucks. They are increasingly being used in power drills with key type three-jaw chucks because of the non-slip feature of the hex shank, and the higher torque and variable speed features now common on power drills making them better suited to screwdriving.

With the advent of battery operated screwdriving tools and drills utilizing three-jaw key chucks, and quick release chucks for the hex shank either to replace or be used in conjunction with the key chuck, ref. U.S. Pat. No. 4,692,073, the use of, and utility of, the hex shank screwdriving accessories, including the bit holders associated with the present invention, is seeing an exponential growth. It can therefore be expected that the new utility, provided by the present invention, will also experience this growth.

The following detailed description will refer frequently to bit holders having hexagon shanks. To clarify the orientation of various parts and features of these bit holders, the bit or driving end will be referred to as forward or front, and the shank or driven end will be referred to as rearward or back.

SUMMARY OF THE INVENTION

The invention described and claimed herein comprises an adaption apparatus to be attached to the end of an insert bit holder. It provides a means to locate the depth of a threaded screw type fastener relative to the surface of the work piece being fastened.

The depth locating apparatus is comprised of a sleeve which is threaded on to the threaded end of a bit holder; an O'ring disposed therein to frictionally retain an insert bit against axial pull out forces; or alternately has a circular bore with internal shoulder to adapt to and locate on the cylindrical body of a bit holder having bit retaining means therein, the sleeve being secured to the bit holder by means of a set screw.

The sleeve is externally threaded to receive two internally threaded and identical lock rings, preferably of a non-marring abrasion resisting material. The location of the outer ring relative the driving tip of an inserted bit is such that when its forward face makes contact with the work piece surface, the screw will be at the desired depth. This depth can be adjusted to any desired depth by threading the outer ring to the correct relative position on the sleeve. The outer ring is restrained against axial movement relative to the sleeve and the bit by the locking action of the inner lock ring.

Among the objects of this invention are the following:

To provide a new and useful apparatus for locating the depth of a driven screw relative to a work piece surface;

To provide a new and useful apparatus for locating the depth of a screw, which adapts to an insert bit holder;

To provide a new and useful depth locating apparatus which can be used interchangeably with the bit retaining nose cap of a threaded nose cap type bit holder;

To provide a new and useful depth locating apparatus which can be adapted to a bit holder having a straight cylindrical body and bit retaining means therein;

To provide a new and useful depth locating apparatus having a bit torque transmitting socket and bit retaining annular ring therein to adapt to the threads of a cylindrical body having a power shank for transmitting torque thereto.

BRIEF DESCRIPTION OF THE DRAWING

FIG. 1 is a sectioned elevation view of the depth locator device constructed in accordance with this invention, shown mounted to a conventional magnetic bit holder partially sectioned, with a fastening element in the located position.

FIG. 2 is a partially sectioned elevation view of the bit retaining threaded nose cap of the conventional bit holder in the removed position.

FIG. 3 is an elevation view of the disasssembled depth locator device illustrating the elements thereof in section and partial section and their relationship to the bit holder and its nose cap shown in FIG. 2.

FIG. 4 is a sectioned elevation view of an alternate embodiment of the depth locator device of the present invention mounted on a different type of conventional bit holder.

DESCRIPTION OF THE PREFERRED EMBODIMENT

FIG. 1 is a sectioned elevation view of a preferred embodiment of the invention shown mounted to a conventional nose cap type magnetic bit holder 10. The bit holder, which is not claimed to be a part of this invention, is generally comprised of: a cylindrical body 11, of a non-magnetic metal such a stainless steel or beryllium copper; a shank 12 of polygonal cross section, usually hexagonal of either a magnetic or non-magnetic material; a threaded portion 13 on the forward end terminating at shoulder 14; a central hollow portion 15 to receive a permanent magnet 16; a polygonal bore 17, usually hexagonal, extending to the front end 18, shown in FIG. 3, this bore receiving an insert type screwdriving bit 19 of a corresponding cross section.

In the bit holder of this embodiment, a detachable nose cap assembly 20 is utilized to retain the screwdriver bit 19 against axial pull out forces. FIG. 2 is a partially sectioned elevation of this nose cap assembly 20, and is shown detached from the body 11, and is comprised of two components: the cap body 21 and a ring 22.

The cap body 21 is typically cylindrical in shape and is internally threaded with threads 23 which mate with the external threads 13 of the body 11. The internal threads 23 intersect and are terminated by an annular groove 24. A circular bore 25, of a diameter less than the minor diameter of the internal threads 23 and of a diameter of sufficient size to allow minimal clearance with the most extreme circumferential surfaces of the bit 19 is located between the groove 24 and the forward end of the nose cap body 21.

The ring 22, circular in cross section and continuous circumferentially, is seated and retained in the groove 24. The ring 22 is of an elastomeric material, such as rubber. It has an internal diameter less than the circumferential diameter of the extremities of the bit 19, such that a frictional holding force is developed on the bit 19. This internal diameter as well as the cross section of the ring 22 is sized to achieve the desired retention force to overcome pull out forces developed when the bit 19 tends to stick in the recess of a fastener. The ring 22 is typically of a type generically known as an O'ring, very commonly and inexpensively available if replacement is required.

The length of the external threads 13, the depth of the internal threads 23, and the location and size of the annular groove 24 are such that when the nose cap assembly 20 is threadedly engaged to the body 11, the ring 22 becomes further compressed against the bit 19 and into the groove 24, by the bit holder end surface 18. This increases the frictional force holding the bit against pull out, reaching a maximum when the internal threads 23, of the cap body 21, are fully engaged with the external threads 13 of the bit holder body 11.

The above description is of the most commercially available threaded nose cap bit holder at the time of this invention. It is used primarily in power operated hand tools for driving threaded fasteners, utilizing appropriate bits for the driven fasteners. While the bit holder described above is not the subject of this invention, the detailed description is given to facilitate a complete understanding of the features and function of the apparatus of the present invention.

The apparatus of the present invention is shown in the completely sectioned elevation view of FIG. 1 as assembled to the aforementioned bit holder 10.

FIG. 2 shows the aforementioned nose cap 20 in a partially sectioned view disassembled from the aforementioned bit holder 10.

FIG. 3 shows partially sectioned views of the elements of the present invention in a disassembled state showing its assembly relationship to the bit holder 10.

FIG. 4 is an alternate embodiment of the present invention shown assembled to another type of bit holder, commonly referred to as a C'ring type, of high commercial availability.

The preferred embodiment of the present invention is the depth locator adapter 30 shown assembled in FIG. 1. The adapter 30 is comprised of a cylindrical adapter sleeve 31 having a rear face 32 and a front face 33. The sleeve 31 is threaded externally its entire length with threads 34. An internally threaded bore, with threads 35, which mate with threads 13 of the bit holder body 11, extends forward from the rear face 32. The internal threads 35 intersect and are terminated by an annular groove 36. The configuration of the threads 35 and the annular groove 36 are identical to, within manufacturing constraints, the threads 23 and the groove 24, such that the adapter sleeve 31 is interchangeable with the nose cap body 21.

A circular bore 37, coaxial with threads 34 and 35, and with a diameter less than the minor diameter of the internal threads 35, extends from the groove 36 to the front face 33. The diameter of the bore 37 is of such size as to allow clearance with the most extreme circumferential surfaces of the bit 19. The length of the bore 37 is approximately five times the length of the bore 25 of the nose cap body 21; the length to be established by functional considerations. The material of the adapter sleeve 31 can be a non-magnetic or magnetic metal preferably the same metal of nose cap body 21.

The adapter assembly 30 further consists of two each lock rings 40 of cylindrical construction threaded internally with threads 41, end faces 42, and external knurled surfaces 43. The two 40 lock rings are of identical construction, within manufacturing constraints. The rings are preferably of a plastic material having both abrasion resistance and lubricating characteristics, the reason to be discussed in the following assembly and functional descriptions.

The preferred method of assembly of the locator adapter 30 is to thread the two 40 rings onto the adapter sleeve 31 so that the internal threads 41 of the locking rings 40 fully engage the external threads 34 of the 31 adapter sleeve approximately as shown in FIG. 1, the locking rings being rotationally tightened against each other using manual finger pressure.

The incorporation of the elastomeric ring 22 into the annular groove 36 can be made before or after this assembly and can be preferably supplied with the adapter 30 or alternately removed from the nose cap 20 assembly and installed in the groove 36.

The locator adapter assembly 30 with ring 22 installed, is then threadedly engaged with the external threads 13 of the bit holder body 11, until engagement is stopped when the adapter sleeve face 32 contacts the bit holder shoulder face 14.

The axial depth of the adapter sleeve internal threads 35, and the axial length of the bit holder threads 13, are in such relationship that when fully engaged with the sleeve face 32 in contact with the bit holder shoulder face 14, the O'ring 22 will be compressed into the groove 36, and against the bit 19, by the bit holder end face 18. This assures a frictional holding force on the bit 19, sufficient to prevent pull out of the bit 19 by the highest anticipated axial pull out forces caused by the bit 19 sticking in a screw fastener recess.

The fastener 100 is shown with its recess engaged fully with the driving feature of the bit 19. The depth of the outermost surface 101 of the fastener 100 relative to the work piece surface 200, when driven into the work piece, is established by the relative position of the outermost surface 42 of the outermost locking ring 40 to outermost surface 101 of the 100 fastener. This located depth 300 is reached when the surface 42 of the outermost locking ring 40 comes in contact with the work piece surface 200 as the fastener 100 is rotationally driven into the work piece by the integrally assembled bit 19, depth locator adapter 30 and bit holder 10 mounted in the chuck of a power or hand screwdriver.

The depth location 300 of the screw head surface 101 to the work piece surface 200 is thus determined by the outermost locking ring 40 location on the adapter sleeve 31 which is associatively related to the bit 19 and the fastener head surface 101.

To adjust this location, the back-most locking ring 40 is rotationally threaded rearward and out of engagement with forward locking ring 40, which is then threaded forward or backward to the location giving the desired depth location 300. The backmost locking ring 40 is then moved rotationally forward into locking engagement with the forward locating locking ring 40.

The rotational direction of the bit holder adapter assembly is such that the frictional forces introduced between the surface 42 of the outer ring 40 and the work piece surface 200, upon engagement at the located depth, are such as to tighten the locking relationship between the two 40 rings, thus preventing longitudinal movement of the ring surface 42 relative to the locator body 31 and the bit 19. This is predicated on conventional right hand threaded fasteners and right hand threads 13, 34, 35 and 41. To drive left hand threaded fasteners corresponding left hand threads would be required on the locator adapter 30 and the bit holder 10.

In addition to the new utility provided for bit holders, obvious manufacturing and user economies are inherent in the design of the present invention. One obvious advantage is that the depth locator can be adapted to the two different styles of nose cap bit holders eliminating the need for different adapters. Another advantage is that the two 40 locking rings are identical, giving manufacturing cost savings. The interchangeability of the two locking rings offers 4 wear surfaces thus extending the life of the depth locator assembly 30 fourfold. Additionally, the 40 lock rings can be replaced individually, not requiring purchase of the complete adapter assembly 30.

The preferred material of the locking rings 40, i.e., a wear resistant plastic with lubricating characteristic qualities such a graphite-filled nylon in the preferred embodiment, will give additional economic and functional benefits to the user by extending the life of the locking rings 40. This will also cause less abrasion and/or marring of the work piece surface 200.

FIG. 4 is a sectioned elevation view of an alternate embodiment of the invention mounted to an alternate type bit holder 110. This bit holder is of the type most commercially available of the C'ring style, as opposed to the nose cap style of the above described preferred embodiment. The bit holder 110 of this embodiment is likewise not claimed to be part of this invention and is similarly comprised of cylindrical body 111, a shank 112, a central hollow portion 115 to receive a permanent magnet 116.

The body 111 of this alternate bit holder is generally of the same material as body 11, but differs in that the external threads 13 and shoulder 14 are omitted. The cylindrical body 111 continuing forward terminated by end face 114. The ring retaining groove 24 of the nose cap body 21 of FIG. 2 is incorporated in the alternate body 111 which similarly contains a polygonal bore 117 to receive screwdriving bit 19 of a corresponding cross section.

The bore 117 intersects and terminates at an annular groove 123. A circular bore 124 of a diameter sufficient to clear the extreme corners of the bit 19 entering from the front end face 114, of the body 111 intersects the groove 123. A split ring 125, generally referred to as a C'ring, of discontinuous circumference, generally made of spring wire, is retained in groove 123, and is of dimensions that when so retained will have an internal diameter slightly less than the circumferential diameter of the extremities of the bit 19.

The common bit 19, now in general use and defined in MIL-GGG-B-001222 is provided with notches 126 at its diagonal corners, which are engaged by the ring 125 such that frictional and normal holding forces are developed which oppose a pull out force if the bit 19 tends to stick in the fastener recess.

As with the preferred embodiment of FIG. 1 the detailed description of the alternate bit holder 110 is given to facilitate an understanding of the features and function of the alternate embodiment of the present invention.

This alternate embodiment of the depth locator adapter 130 of the present invention is shown assembled to the 110 bit holder and is partially in section in the elevation view of FIG. 4. This embodiment is similar in construction to the adapter assembly 30, differing only in a modification of the adapter sleeve 31, and shown as adapter sleeve 131 in FIG. 4.

The adapter sleeve 131 is a partially externally threaded cylinder with threads 132 proceeding rearward. The internal threads 35 have been replaced by the bore 133 proceeding from the back end surface 134 terminating in the shoulder 135. The diameter of this bore provides a sliding fit on the external cylindrical surface of the body 111, in assembly engaging and stopped by the 114 end of the cylindrical body 111. A bore 136 from the opposite end 137, of a smaller diameter, similar in description and function to the previous bore 37, intersects bore 133 forming the shoulder 135.

The modification of the adapter sleeve 31 of this embodiment is the addition of an annular shoulder 140 of a diameter greater than the major diameter of the external threads 132 and of a width sufficient to receive a threaded set screw 142.

In this embodiment the lock rings 40 are identical in feature and function to those of FIGS. 1 and 3, but may differ both in diameter and internal thread to accommodate dimensional differences between the two types of bit holders; however, the internal threads 41 are matingly engageable with the external threads 132 of the adapter body 131.

In assembly the set screw 142 is tightened sufficiently to prevent axial movement outwardly of the adapter body 131. The function of the locking rings in assembly is the same as that of the preferred embodiment of FIG. 1, utilizing the same procedure for setting the depth location 300.

The above embodiments show the apparatus of this invention used in conjunction with the two most commonly used types of bit holders. Both types embody a hexagonal bore to receive and prevent relative rotation between the hexagonal shank of the insert bit and bit holder body. Although in very limited use today, a slight modification of the bit holder shown in FIG. 1 has the torque transmitting hexagonal bore embodied in the nose cap rather than in the bit holder body. To accommodate this type of bit holder the bore 37 would be changed from circular to hexagonal, the remaining features and function remaining the same. An obvious disadvantage of this type of bit holder is that reversing the torque, for removing a screw, will cause the nose cap to unscrew, thus making it unsuitable for screw removal, thus accounting for its relative limited use.

While the embodiments presented in the previous descriptions and shown in FIGS. 1 and 4, refer to the magnetic type bit holder, these embodiments are equally applicable to non-magnetic bit holders, in this instance the magnet face would be replaced by a shoulder surface at the bottom of the non-circular bit driving bore.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and appended claims have been prepared in accordance with applicable patent laws and the rules promulgated under the authority thereof.

What is claimed is:

1. A depth locating apparatus to control the depth of a driven screw type fastener head relative to the surface of the work being fastened comprised of in combination:

a bit holder having a cylindrical body and a socket in the body for receiving a bit;

an external threaded portion disposed on the cylindrical body about the socket;

an insert type screwdriving bit disposed in the socket;

sleeve means to be secured to the bit holder, including a bore having a threaded portion for engagement with the external threaded portion of the cylindrical body of the bit holder, an outer end on the threaded portion of the bore in the sleeve means through which the screwdriving bit extends, a non-threaded internal portion of the bore having a diameter smaller than the diameter of the threaded portion of the bore, an internal circular groove located in said non-threaded internal portion adjacent to the outer end of the threaded portion of the bore.

a ring of elastomeric material disposed in the internal circular groove to bear on and frictionally retain the screwdriving bit when the sleeve means is threadedly engaged with the bit holder, and a threaded cylindrical external surface;

two rings, each of said rings having a circular bore threaded to engage the threaded cylindrical external surface of the sleeve means, one ring being a work engaging ring, the other being a locking ring, said rings threadedly assembled to the sleeve means; and said sleeve means, when attached to said bit holder, with the bit disposed therein, comprises, in operation, depth locating apparatus to determine the depth of a screw type fastener head relative to a workpiece surface, said depth being determined by the location of the work engaging ring relative to the bit, the rings being threadedly adjustable for depth variation, and the desired depth being set by the locking action of the locking ring against the work engaging ring.

* * * * *